United States Patent [19]

Woolford

[11] 4,236,359

[45] Dec. 2, 1980

[54] SELF SECURING MERCHANDISING KIOSK

[76] Inventor: Anthony Y. Woolford, P.O. Box 522, Amherst, N.H. 03102

[21] Appl. No.: 8,251

[22] Filed: Feb. 1, 1979

[51] Int. Cl.[2] ..... E04B 1/346

[52] U.S. Cl. ..... 52/66; 52/79.1

[58] Field of Search ..... 52/66, 65, 67, 64, 72, 52/73, 79.1, 79.5; D25/16; 312/312

[56] References Cited

U.S. PATENT DOCUMENTS

| | | | |
|---|---|---|---|
| D. 197,766 | 3/1964 | Roxburgh | D25/16 |
| 2,563,886 | 8/1951 | Taylor | 52/65 |
| 2,792,794 | 5/1957 | Miller | 52/66 X |
| 2,867,853 | 1/1959 | Lindgren | 52/73 X |
| 3,674,305 | 7/1972 | Stewry | 52/66 X |

*Primary Examiner*—Carl D. Friedman

*Attorney, Agent, or Firm*—Strimbeck and Soloway

[57] ABSTRACT

A merchandising kiosk has a base shell enclosing a working area for a salesperson. The base shell has display cabinets, the top of which form a continuous counter about the working area. There is an entrance door in the base shell. A canopy that can be raised and lowered mates with the counter in the canopy's lowered position to seal the interior of the kiosk against theft and vandalism. The counter top above the door has a stop that engages the door and prevents it from being opened when the canopy is in the lowered secured position.

The canopy for reasons of strength and stability are supported by at least two spaced apart posts within the central portion of the working area which posts are extensible from the closed to the open position. The canopy is raised and lowered preferably by a hydraulic piston driven by an electric pump. The hydraulic machinery and the posts are encased in a central vertical display unit.

8 Claims, 4 Drawing Figures

RAISED POSITION
LOWERED POSITION

SELF SECURING MERCHANDISING KIOSK

INTRODUCTION

With the advent of large enclosed public areas and pedestrian concourses such as shopping malls, airport terminals, hotel lobbys, convention centers, and the like, there has been a need for a portable or movable merchandising unit that could be readily set up in and removed from such areas. This permits maximum use and rental income to be enjoyed in such areas and yet leaves them free for other future uses consistent with the main purpose for which the areas were built by simple moving or removal of the merchandising units.

The present invention proposes a merchandising kiosk that is self contained and self securing. Usually this type of kiosk will be used to market a narrow or single line of merchandise such as perfume and cosmetics; tobacco products; newspaper and magazines; coffee, tea and spice; candies; jewelry; or cheeses and specialty foods. It is particularly advantageous for a supplier of such lines of merchandise to design and stock a kiosk in accordance with a marketing scheme and to provide the kiosk to a retailer on a franchise basis. The kiosk can be readily designed to effect a particular motif.

As such kiosks will not usually be operated on a 24 hour basis, it is necessary to have them so designed that they may be closed and left unattended but secure against theft and vandalism.

Needless to say, the kiosks must be of attractive sales stimulating design and as they most often will be attended by one person, they should be able to be opened up and closed down quite simply and readily.

The present merchandising kiosk meets these and other desiderata.

THIS INVENTION

The present invention is a merchandising kiosk having a base shell totally enclosing a working area accommodating one or more salespersons. The base unit includes peripheral cabinets adapted to display merchandise through windows, the tops of which cabinets help define a continuous counter about the base unit. The base shell has an entrance door which is preferably secured by engagement with the underside of a portion of the counter. The counter portion when pivoted upwardly permits opening of the door and entrance to the working area.

The base unit has an attractive canopy over it. The canopy has a raised and lowered position. The canopy is at least peripherally coextensive with the inner edge of the counter such that the canopy in the lowered position matches with the base shell counter top and forms a secured area within the kiosk. In its raised position, the canopy is above the head of the person working within the kiosk.

In accordance with this invention, the canopy is securely supported for being raised and lowered by at least two spaced apart posts within the central portion of the working area. The posts are extensible from the collapsed position to a raised position, preferably by means of an electric pump-driven hydraulic piston. The posts, and the raising and lowering equipment, are preferably encased in a vertical display unit in the central portion of the working area about which the salesperson may work.

Preferably, the electric pump is operated by a key lock adjacent to the door which permits the person wishing to put the merchandising unit in operation to engage the key lock and operate the pump—automatically raising the canopy and opening up the kiosk for business. In its lowered position the canopy rests on the base shell and secures the kiosk and cannot be moved from that position unless one has the proper key to work the electric switch.

THE DRAWINGS

DESCRIPTION

Figure 1:
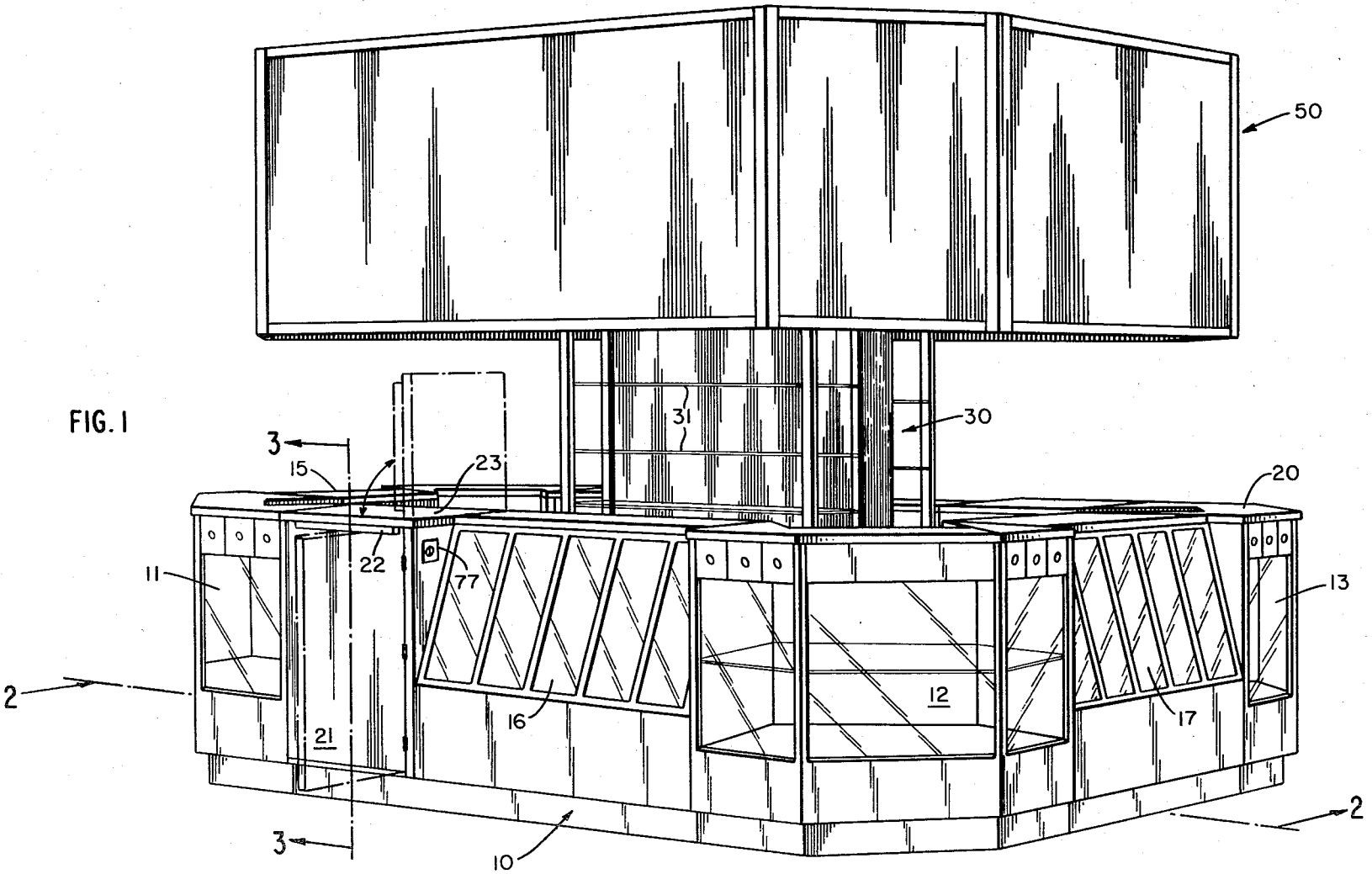
FIG. 1 is a prospective view of a preferred embodiment of kiosk of this invention.

With reference to FIG. 1, the kiosk of this invention comprises a base shall 10, a central display unit or shelves 30 and a canopy 50. The canopy 50 mates with a counter surface 20 on the base shell 10 and both, as illustrated, are octagonal.

The base shell has enclosed display cabinets which as shown consist of corner units 11, 12 and 13 having vertical windows and side units 15, 16 and 17 having slanted windows. Only the display cabinets visible in the drawing have been numbered but there are like units in the hidden sides of base shell 10.

As can be seen base shell 10 totally encloses a working area within the kiosk about display unit 30 with there being a counter 20 about the shell and over the display cabinets.

The counter and portions of it can have any convenient height usually in the range of 28 to 38 inches. The outer periphery of base shell 10 will usually encompass an area in the range of 75 to 200 square feet and have a size such as $8\times10$ feet or $12\times15$ feet. This size gives kiosks that can be readily moved in toto or can be easily broken down into a few sections and moved.

Entrance is gained to shell 10 by a door 21. A stop 22 on the underside of hinged portion 23 of counter 20 engages the top of door 21 and prevents it from being opened when portion 23 is in place. When canopy 50 is in its lowered position on top of counter 20, the hinged portion 23 cannot of course be raised and door 20 cannot be opened.

Central unit 30 encases the canopy support and raising mechanism (FIG. 2) and can have a counter and storage compartment about it (not shown) as well as having display shelves 31 as illustrated.

While not shown on FIG. 1, the outer vertical surfaces of canopy 50 can carry such pictorial information and advertising as may be desired.

Figures 2, 3, 4:
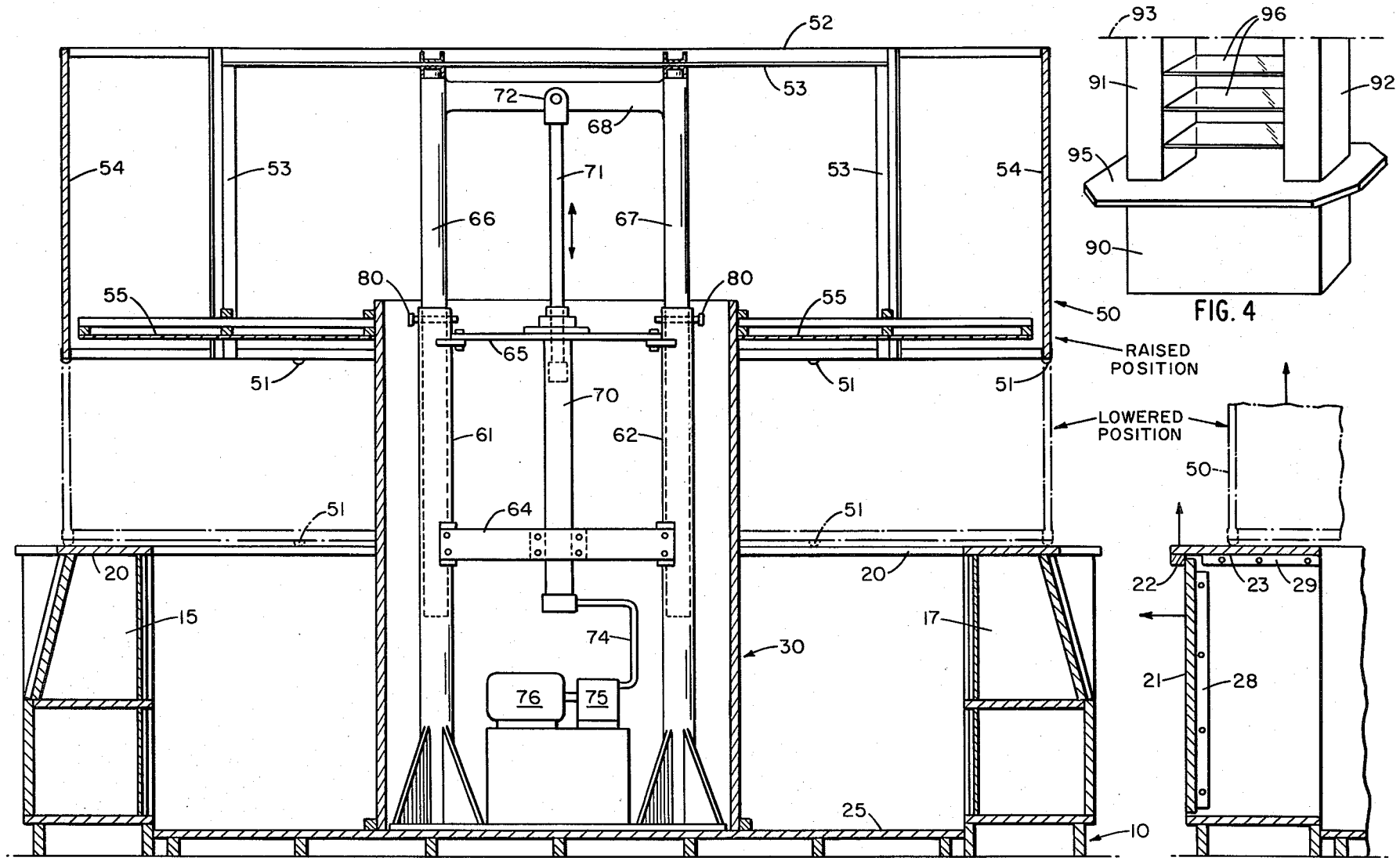
FIG. 2 is a sectional elevational view taken along the line 2—2 of FIG. 1.
FIG. 3 is a sectional elevational view of the entrance door in the counter taken along line 3—3 of FIG. 1.
FIG. 4 is a prospective view of another type of vertical shelf unit that can be used to encase the canopy supporting and raising and lowering mechanism.

Referring to FIG. 2, it can be seen that the kiosk has an interior floor 25 upon which unit 30 rests and that shell 10 fits thereabout.

Canopy 50 is shown in the raised position in FIG. 2 in solid outline and in the lowered position in shadow outline. When lowered, rubber buttons or cushions 51 on the uncerside of canopy 50 rest on counter 20. Canopy 50 has a suitable top 52 and an internal supporting structure of angle irons 53 onto which is hung the out-side display panels 54. The unit has a ceiling 55 which can have suitable concealed lighting (not shown) and can have doors in it so that the interior portions of the canopy particularly those behind panels 54 can be used for storage.

That portion of the ceiling 55 that abuts the interior unit 30 is not attached thereto such that it can slide down with the canopy when the canopy is lowered, about unit 30.

The internal supporting structure 53 of the canopy is held by the raising and lowering mechanism contained within unit 30. This consists of two posts 61 and 62 that are spaced apart by horizontal spacers 64 and 65. Posts 61 and 62 have telescoping therein, posts 66 and 67, respectively, attached by cross member 68 at their upper portions and affixed to the supporting framework 53 of canopy 50.

The cross members 64 and 65 support hydraulic unit 70 the piston rod from which moves upwardly and downwardly and is attached at 72 to cross member 68. The hydraulic unit 70 is operated by means of hydraulic pressure obtained through line 74 from electric motor driven pump 75, the electric motor being indicated at 76.

Referring to FIG. 3 the door unit is shown in cross section, the door being indicated at 21, the portable counter section at 23 and the door stop at 22. The hinge for the door is shown at 28 and for the counter portion at 29.

Electric motor 76 is operatively connected to a key switch 77 (see FIG. 1) adjacent the entrance door 21. In operation, to open the kiosk up for business when the canopy is down securing the kiosk one inserts key in lock 77 and activates pump 76 which causes the hydraulic cylinder 70 to raise canopy 50 to its uppermost position where it can be locked safely into position by insertion of the removal pins 80. The hydraulic unit then can be shut off and the pressure allowed to fall off.

It can be appreciated that this method opening up the kiosk is quite simple and is to be favored over the construction of previous types of sales stands where one had to lower several large flaps and lock them in place over the selling windows or had to remove large panels out of storage and slide them into place in order to secure against theft and vandalism.

In another embodiment, hydraulic cylinder 70 and its piston arm 71 are moved over to be adjacent to one of the posts 61 and 62 with cross member 64 and 65 being sufficiently vertically spaced apart to allow unit 30 to be opened up at its eye-level interior portions so that one can look through unit 30. This gives the kiosk a more spacious lighter look and which may be perferred for some situations. This variant is shown in FIG. 4, wherein the base of the center unit about the raising and lowering mechanism is shown at 90. The upper portion of the of the posts are encased in colums 91 and 92. The canopy ceiling line is shown at 93, which corresponds to 55 in FIG. 2. An octagonal counter 95 is provided around columns 91 and 92 and glass display shelves 96 are provided between the columns.

What is claimed is:

1. In a merchandising kiosk having a base shell totally enclosing a working area and adapted to accommodate therein at least one person, said base including: (1) peripheral cabinets adapted to outwardly display merchandise through windows, the tops of which cabinets end in a continuous counter around said base shell, (2) said continuous center, and (3) an entrance door, the improvements comprising:

A canopy having a raised and a lowered position and being at least peripherally coextensive with the inner circumference of said base shell, said canopy in said lowered position being adapted to match with the top of said base shell and form a secure area within, and in said raised position to be above the level of the head of said person standing therein;

Said canopy being supported for raising and lowering by at least two spaced apart posts within the central portion of said working area, said posts being extensible from a collapsed position to effect said raised position;

And said posts being encased at least in part in a vertical display unit about which said person may work.

2. The kiosk of claim 1 having door lock means preventing opening of said entrance door when said canopy is in said lowered position.

3. The kiosk of claim 2 wherein said door lock means comprise having the portion of said continuous counter above said entrance door hinged to pivot upwardly to an open position, the underside of said portion of counter having a stop which when said portion of counter is in the down-closed position engages said entrance door and prevents it from being opened.

4. The kiosk of claim 2 wherein said posts are raised and lowered by means of an electric pump-driven hydraulic piston within said vertical display unit, wherein a switch operatively connecting to said electric pump is located adjacent to said entrance door on the exterior wall of said base and wherein when said switch is activated to raise said hydraulic piston and said canopy said canopy moves from a position of securing and enclosng, said working area to one where said kiosk is open for business and said portion of counter can be raised to free said entrance door.

5. The kiosk of claim 4 wherein said switch is key operated.

6. The kiosk of claim 4 wherein said hydraulic piston is contiguous to one of said posts and the center-eye level portion of said vertical display unit is see-through, giving the kiosk a more open spacious appearance.

7. The kiosk of claim 1 wherein said base shell is octagonal in plan view.

8. The kiosk of claim 7 wherein said canopy has an external vertical sides and is also octagonal in plan view, the interior periphery of said canopy having storage space therein.

* * * * *